United States Patent [19]

Cantine, Jr. et al.

[11] 3,942,432

[45] Mar. 9, 1976

[54] CONTROL SYSTEM FOR A VEHICLE PRESS

[76] Inventors: Thomas G. Cantine, Jr., R.D. 2, Mt. Pleasant Road, Fulton, N.Y. 13069; Robert J. Stacy, 7879 Broadfield Road, Manlius, N.Y. 13104

[22] Filed: Oct. 15, 1974

[21] Appl. No.: 514,594

[52] U.S. Cl. ..... 100/53; 100/258 R; 100/269 R; 100/DIG. 1

[51] Int. Cl.[2] ..... B30B 9/32; B30B 1/32

[58] Field of Search ..... 100/53, 52, 46, 48, 258 R, 100/258 A, DIG. 1, 269 R; 72/441, 447; 83/624; 91/177

[56] References Cited

UNITED STATES PATENTS

| | | | |
|---|---|---|---|
| 2,309,944 | 2/1943 | Flowers | 100/258 A |
| 2,317,563 | 4/1943 | Tucker | 100/46 |
| 3,070,146 | 12/1962 | Ferranti | 100/46 UX |
| 3,154,925 | 11/1964 | De Vita | 91/412 X |
| 3,318,231 | 5/1967 | Felts | 100/52 |
| 3,404,622 | 10/1968 | Flanagan | 100/DIG. 1 |
| 3,757,680 | 9/1973 | Williams | 100/258 A |

*Primary Examiner*—Billy J. Wilhite
*Attorney, Agent, or Firm*—Bruns & Jenney

[57] ABSTRACT

An automatic control system for use with a known type of vehicle crushing press that is presently equipped with manual or semi-automatic controls. The press includes a base and a pressure head that can be moved vertically toward the base to crush a vehicle positioned thereon. Movement of the pressure head is effected by an independently operable hydraulic cylinder at each end of the head, and the control system of the invention is adapted to be integrated with the hydraulic system for the cylinders. The control system provides for automatic skewing of the pressure head during the crushing operation, automatic termination of the crushing operation and, if desired, automatic repetition of the operation after a predetermined time lapse.

5 Claims, 6 Drawing Figures

CONTROL SYSTEM FOR A VEHICLE PRESS

BACKGROUND OF THE INVENTION

This invention relates generally to apparatus for crushing junked vehicles, and has particular reference to an automatic control system for use with a known type of vehicle crushing press.

The vehicle press for which the control system of the invention is particularly adapted is manufactured and sold by Mobile Auto Crushers Corporation of America, Oklahoma City, Okla. It is described in U.S. Pat. No. 3,404,622, granted Oct. 8, 1968, and reference may be had to this patent for a detailed description of the press.

Briefly, the press comprises a base and a pressure head that can be moved vertically toward the base to crush a vehicle positioned thereon. Movement of the pressure head is effected by an independently operable hydraulic cylinder at each end of the head, and the control system of the invention is adapted to be integrated with the hydraulic system for the cylinders.

At present, the hydraulic system for the press is operated by hand levers or, if desired, it may be operated by radio remote control. In either case, the operation of the press must be controlled by an operator who is on the spot or within a few hundred yards, and generally the operator must be within sight of the press during operation. Thus, the operator must sense when the pressure head should be changed from a straight downward movement to an inclined or skewed downward movement, and also when the crushing has been completed so that the pressure head can be raised to its starting position.

SUMMARY OF THE INVENTION

The control system disclosed herein is a self-contained, independently powered control package that can be integrated with an existing manually controlled or remotely controlled vehicle press hydraulic system to provide fully automatic operation of the press. For a manually controlled hydraulic system, the control system of the invention also includes a supplemental closed loop hydraulic system as will be explained hereinafter. With the control system, the operator is freed for other work as, for example, operating a front-end loader to bring vehicles to the press.

The control system of the invention provides for automatic skewing of the pressure head during the crushing operation and also automatically terminates the operation and returns the head to its elevated, starting position. If desired, the system can be set for automatic repetition of the operation after a predetermined time lapse.

DESCRIPTION OF THE PREFERRED EMBODIMENTS

Figure 2:
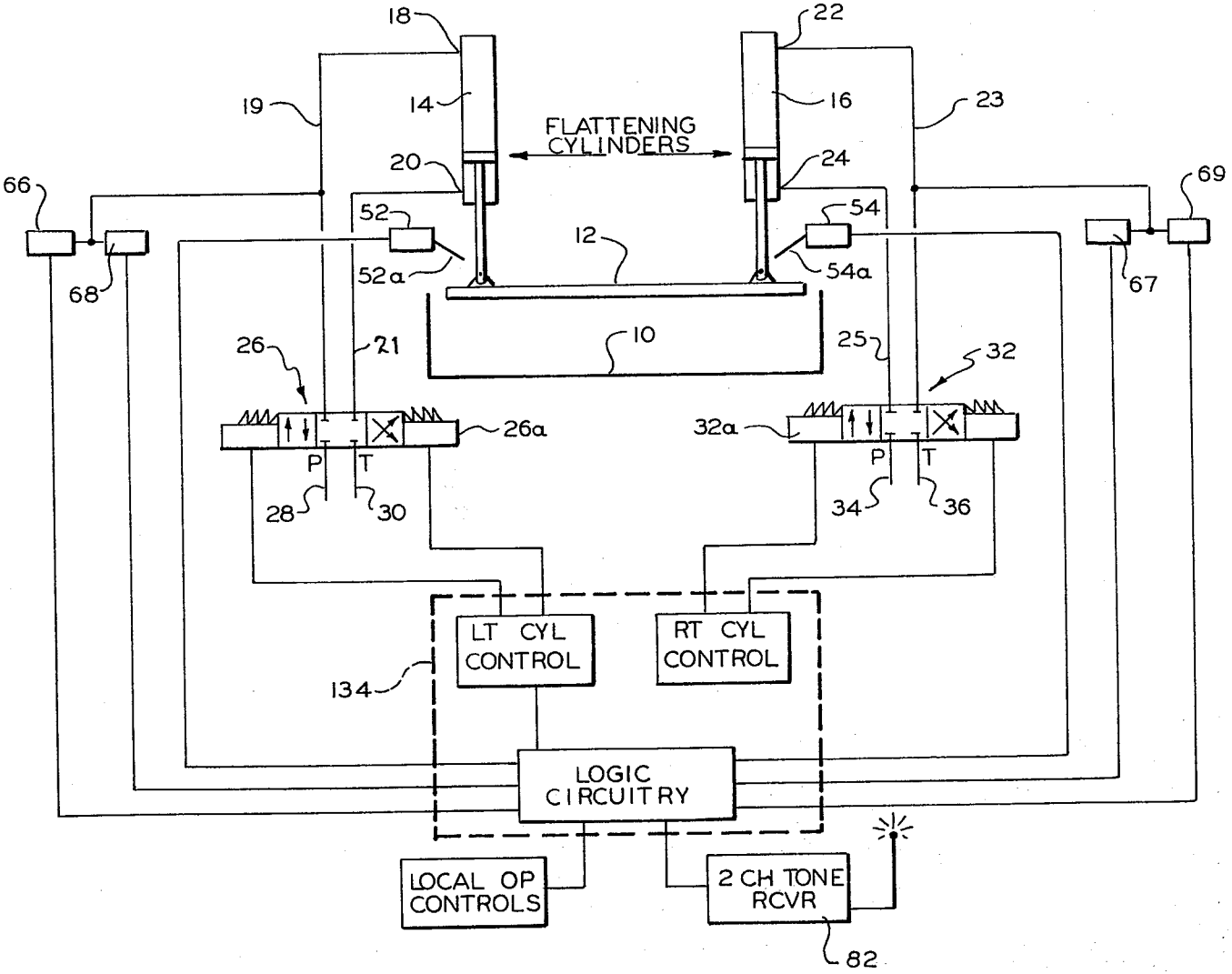
FIG. 2 is a block diagram illustrating the control system of the invention as integrated with an existing remotely controlled or semi-automatic vehicle press hydraulic system.
Figure 3:
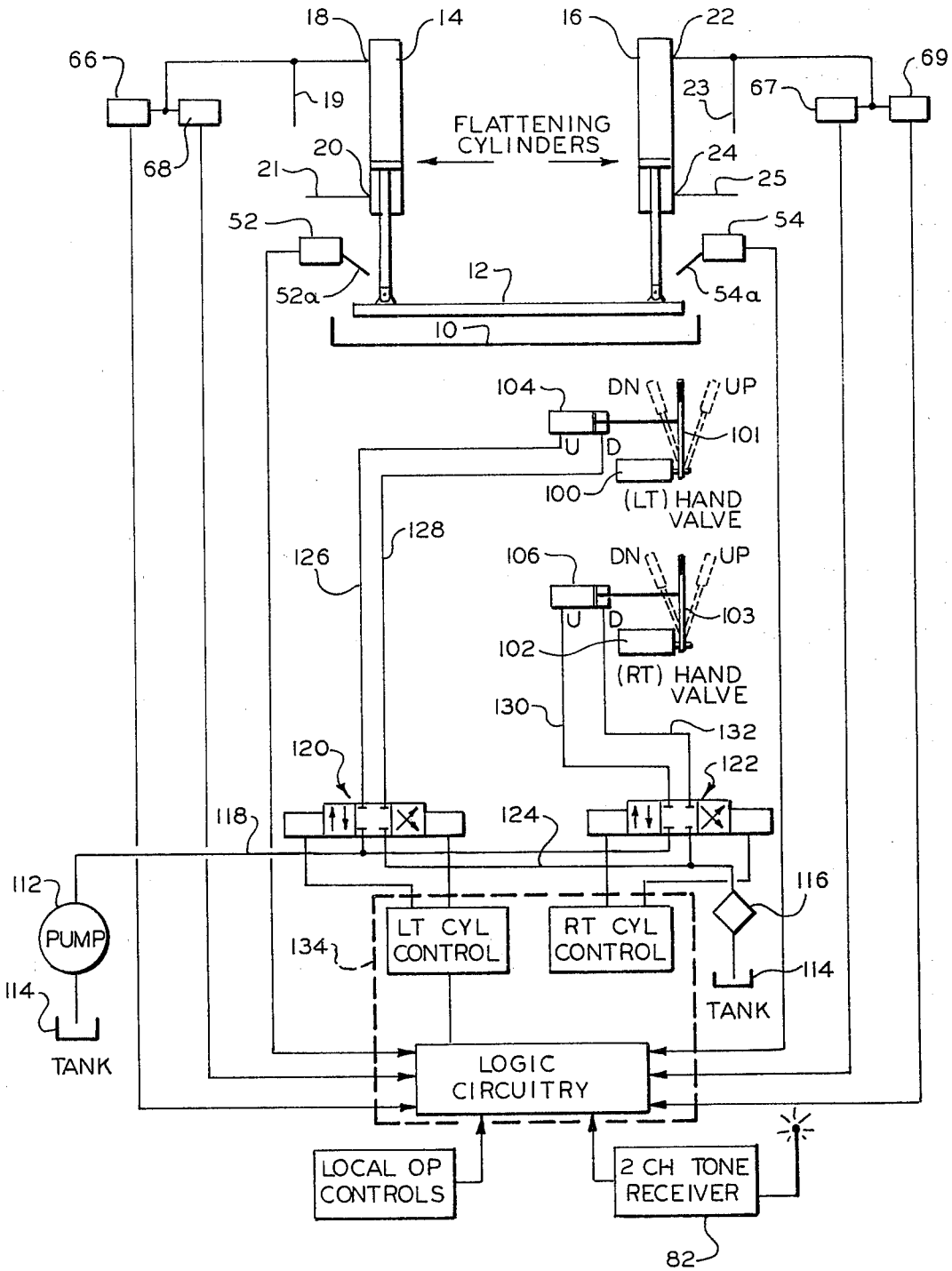
FIG. 3 is a block diagram illustrating the control system of the invention as integrated with an existing manually controlled hydraulic system.

Referring now to the drawings, in each of FIGS. 2 and 3 there is a schematic illustration of the most essential components of a vehicle crushing press of the type disclosed in U.S. Pat. No. 3,404,622 cited above. These components are a base 10 and a pressure head 12 that can be moved vertically by independently operable hydraulic cylinders 14,16 toward the base to crush a vehicle (not shown) positioned thereon.

The left cylinder 14 has a DOWN port 18 and an UP port 20 respectively connected to fluid conduits 19 and 21. Similarly, the right cylinder 16 has DOWN and UP ports 22 and 24 connected to conduits 23,25. The direction of the fluid through conduits 19 and 21 is controlled by a solenoid operated two-way valve 26, FIG. 2, which is also connected by conduit 28 to the fluid pump and by a return line 30 to the fluid tank (pump and tank not shown) of a conventional hydraulic system, the fluid in the preferred embodiment being oil. Fluid through conduits 23 and 25 is controlled by a solenoid operated two-way valve 32 that is also connected by conduits 34,36 to the hydraulic system pump and tank respectively.

Figure 1:
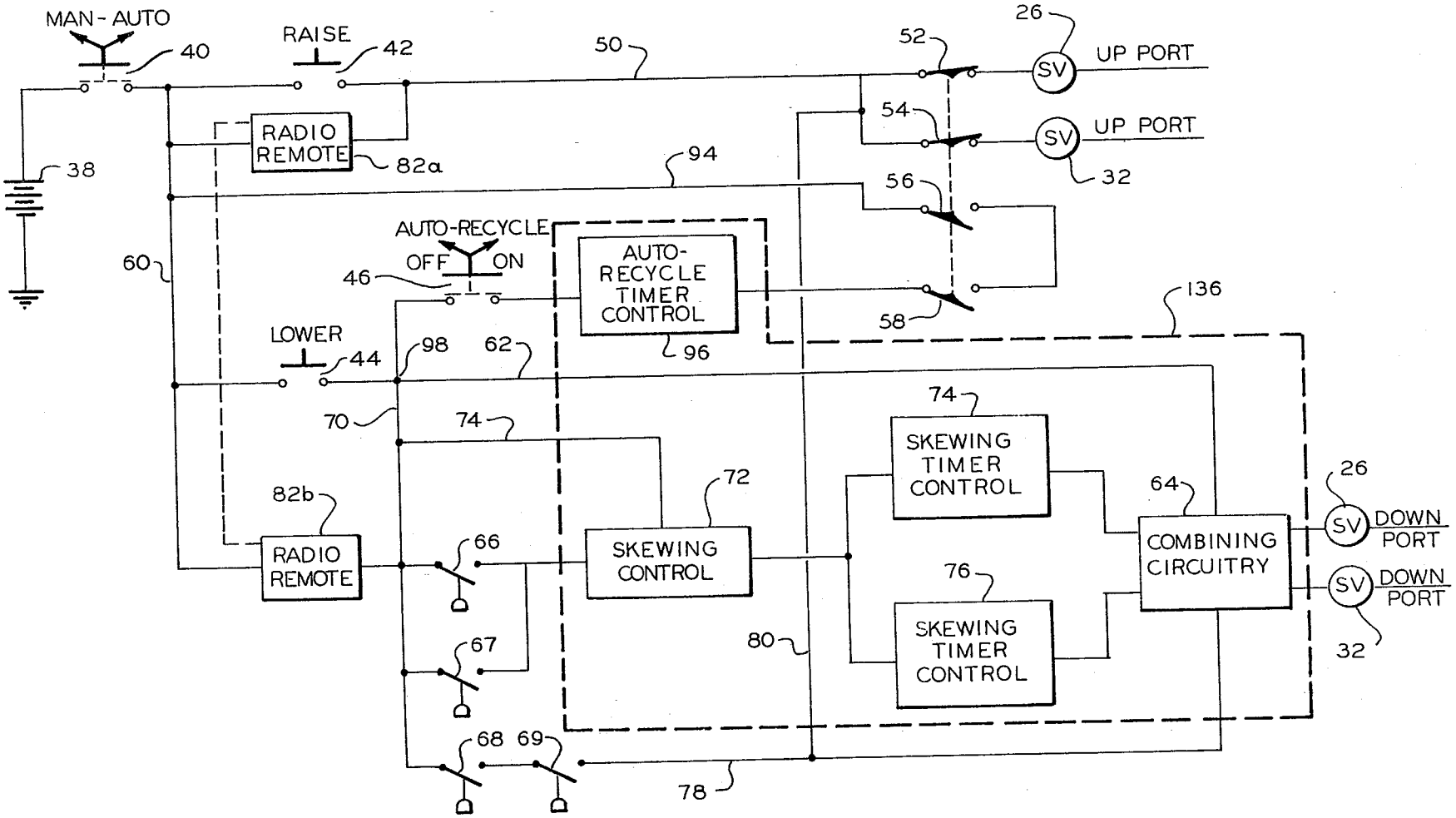
FIG. 1 is a block diagram illustrating the electronic control portions of the control system of the invention.
Figure 5:
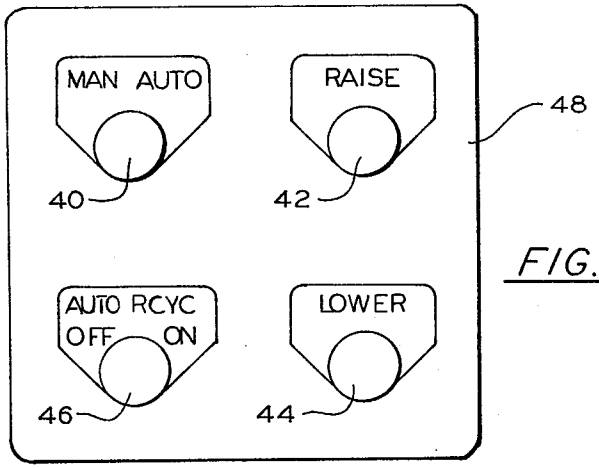
FIG. 5 is a top plan view of a control panel for the control system of the invention.

Electric power for the control system of the invention is provided by a twelve volt storage battery 38, FIG. 1, and in conjunction with this battery there are four switches that may be operator controlled. These are the MANUAL/AUTOMATIC switch 40, the RAISE switch 42, the LOWER switch 44 and the AUTO-RECYCLE OFF/ON switch 46. These switches are assembled in an auxiliary control panel 48, FIG. 5, which can be suitably mounted in the operator's compartment of the vehicle crushing press.

To initiate a crushing operation, switch 40 is placed in the automatic position to energize the control circuitry after which the RAISE switch 42 is closed, FIG. 1. This completes a circuit through the two switches, a conductor 50 and two normally closed limit switches 52,54 to the solenoid valves 26 and 32. The connections to the valves in this circuit are such that the spring loaded spool **26*a* of valve 26 moves to the left as viewed in FIG. 2 and the spring loaded spool 32*a* of valve 32 moves to the right whereby fluid is pumped to the UP ports 20 and 24 of the cylinders 14,16.**

Pumping fluid to the UP ports of the cylinders raises the pressure head 12 to its uppermost or starting position at which point the head engages rockable actuating fingers **52*a* and 54*a*, FIGS. 2 and 3, on the normally closed limit switches 52 and 54 causing the latter to open. At the same time, a pair of normally open switches 56 and 58, FIG. 1, which are interconnected with switches 52,54, are closed for a purpose to be described. Opening the switches 52,54 operates to open switch 42 and also causes the spring loaded spools of solenoid valves 26 and 32 to return to their neutral positions in which positions fluid cannot be pumped to either port of the cylinders 14,16.**

After the pressure head 12 has been raised to its starting position, a vehicle to be crushed is deposited on the base 10 and the LOWER switch 44, FIG. 1, is closed. This completes a circuit through switch 40, conductor 60, switch 44, conductor 62 and combining circuitry 64, forming a part of the electronic controls, to solenoid valves 26 and 32. However, in this circuit the connections to the valves are such that spool 26*a* moves to the right, FIG. 2, and spool 32*a* moves to the left whereby fluid is pumped to the DOWN ports 18 and 22 of the cylinders 14,16 causing the pressure head to move downwardly. As the head moves out of contact with the limit switch fingers 52*a* and 54*a*, the switches are again closed.

The control circuit includes in the DOWN port side of each cylinder 14,16 a pair of pressure switches, the switches being shown at 66 and 68 for cylinder 14 and at 67 and 69 for cylinder 16 in FIGS. 2 and 3. Switches 66 and 67 are set for approximately 2200 psi and switches 68 and 69 are set for approximately 2500 psi. As indicated in the block diagram of FIG. 1, the 2200 psi switches 66,67 are arranged in parallel and the 2500 psi switches 68,69 are in a series type arrangement.

During its initial downward movement, pressure head 12 is disposed in a substantially horizontal position. Upon encountering the vehicle during continued downward movement of the head, resistance builds up in the hydraulic system proportional to the pressure needed to crush the vehicle. As previously noted, the cylinders 14,16 are independently powered and controlled and therefore at some point it is very probable that the pressure sensed by one cylinder will be different from that sensed by the other due to variations in the contour and structure of the vehicle from end to end.

At some point during the crushing operation, the pressure in the hydraulic system will increase to 2200 psi and when this happens either switch 66 or 67 will close depending on which cylinder senses this pressure. When either switch 66 or 67 closes, a circuit is completed through switch 40, conductor 60, switch 44 and a conductor 70 to energize skewing control circuitry 72 and place the control system in the automatic skewing mode. Upon energizing the skewing control circuitry, a conventional time delay circuit in the control circuitry operates after a short time to lock pressure switches 66 and 67 out of the system and current flow is switched from conductor 62 to a lock-out bypass conductor 74 leading to the skewing control 72.

In the automatic skewing mode, the skewing control 72 operates to alternately energize the solenoid valves 26,32 for the left and right cylinders 14,16, FIG. 2, starting with the cylinder that did not first sense the 2200 psi pressure in its hydraulic system. Each solenoid valve remains energized for a predetermined length of time, as for example 5 seconds, the time duration being controlled by a pair of skewing timer controls 74 and 76 connected in parallel between the skewing control 72 and combining circuitry 64. The timer controls 72, 72,74, which include conventional time delay networks, respectively control the time of energization of solenoid valves 26,32 and thus the time that fluid is pumped to the DOWN ports 18 and 22 of cylinders 14,16.

With the control system in the automatic skewing mode, alternate incremental downward movement of the cylinders will continue until a pressure of 2500 psi is sensed in both cylinders causing the pressure switches 68 and 69 to close. When this happens, a circuit is completed through switch 40, conductor 60, switch 44, conductor 70, switches 68 and 69 and a conductor 78 to the combining circuitry 64. This causes the latter to deenergize the skewing control 72 and the solenoid valves 26,32 whereby the spring loaded valve spools return to neutral position. At the same time, current in conductor 78 flows through conductor 80 and the limit switches 52,54 to energize solenoid valves in the opposite direction, i.e. so that fluid is pumped to the UP ports 20 and 24 of cylinders 14,16. In this connection, it will be recalled that switch 42 was opened after the pressure head 12 was previously raised to its starting position.

Pumping fluid to the UP ports of the cylinders again raises the pressure head to its starting position at which point the actuating fingers 52*a* and 54*a*, FIG. 2, of limit switches 52,54 are engaged by the head causing the switches to open. This in turn deenergizes solenoid valves 26,32 and operates to open switch 44 whereupon the crushing cycle is completed.

Prior art vehicle presses that are equipped with remotely controlled or semi-automatic hydraulic systems include solenoid valves such as valves 26 and 32 in FIG. 2 to control the direction of the fluid through the conduits that connect the cylinder ports with the pump and tank. Electronic circuitry as shown in FIG. 1 for controlling the valves is not provided; rather, radio control is employed. Thus, the system includes a two-channel tone decoder/receiver that is directly connected to the solenoid valves and a remote two-channel tone encoder/transmitter that controls the receiver to raise or lower the pressure head, operating the cylinders either together or individually.

As the remote control feature may at times be desirable it is incorporated in the electronic controls of the invention. Referring to FIG. 2, the controls include a two-channel tone decoder/receiver 82, the receiver being diagrammatically shown in two parts 82*a* and 82*b* in FIG. 1. The parts 82*a*,82*b* of the receiver are respectively connected in parallel with the RAISE and LOWER switches 42,44 whereby the crushing cycle described above can be carried out without the necessity for an operator to manually close the switches.

Figure 6:
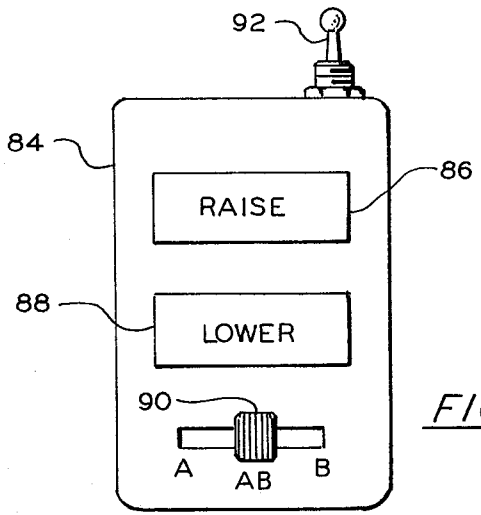
FIG. 6 is a side elevation of a transmitter that can be used for remote control operation.

The receiver 82 can be controlled from a point remote from the vehicle press by a two-channel tone encoder/transmitter 84, FIG. 6, which is contained in a pocket sized enclosure. The transmitter has RAISE and LOWER pushbuttons 86,88 corresponding to switches 42,44 in FIG. 1 and a three position channel selector switch 90 for selection of either or both of the channels. The transmitter also includes an internal antenna (not shown) and a telescoping external antenna 92 for longer range.

In addition to providing for automatic control in a single cycle of operation (in which one vehicle is crushed), the control system of the invention provides for automatic repetition of the cycles without intervening operator control. Thus, in the circuitry of FIG. 1 there is a circuit that bypasses the LOWER switch 44, the circuit including a conductor 94 connected to conductor 60, the normally open switches 56 and 58, an auto-recycle timer control 96 and the auto-recycle OFF/ON switch 46, all in series, with one side of the switch being connected to conductor 70.

In the description of a cycle of operation above, it was stated that when the pressure head 12 is raised to its uppermost or starting position, after initially closing the RAISE switch 42, normally closed limit switches 52,54 open and the interconnected, normally open switches 56,58 close. Now, if at this time the auto-recycle switch 46 is in the ON or closed position, a circuit will be completed through the bypass circuit just described to the point designated 98 in the circuitry just as though the LOWER switch 44 had been closed. Accordingly, since the pressure head automatically returns to its starting position at the end of each cycle as above described, if the auto-recycle switch 46 is in the ON position, recycling will automatically occur until switch 40 or 46 is opened. However, because a vehicle is usually deposited on or removed from the bed 10 of the press between successive cycles, the bypass circuit includes the timer control 96 which has a conventional time delay circuit for delaying the start of each new cycle for a predetermined time interval.

FIG. 3 illustrates how the control system of the invention can be integrated with an existing manually controlled hydraulic system in a vehicle press. In the manually controlled system, the direction of the hydraulic fluid through the conduits 19, 21, 23 and 25 is controlled by hand lever operated two-way valves 100 and 102, FIGS. 3 and 4. These valves are connected by suitable conduits to the pump and tank (not shown) of the existing system and, while not shown in FIG. 3, valve 100 is connected to conduits 19 and 21 and valve 102 is connected to conduits 23 and 25. With this arrangement, forward or backward movement of the valve hand levers 101 and 103 causes fluid to be pumped to the DOWN or UP ports of cylinders 14 and 16.

Figure 4:
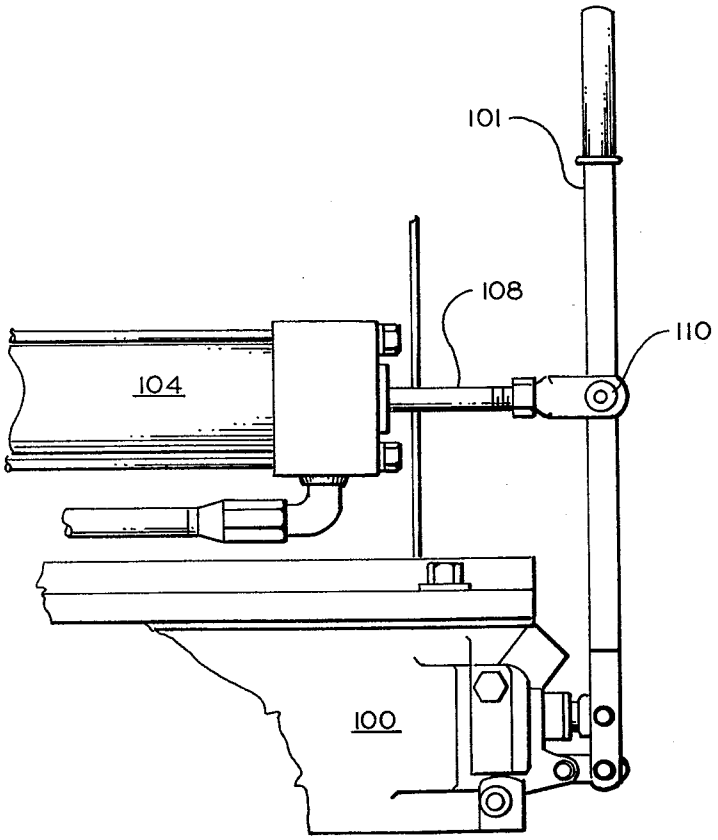
FIG. 4 is a fragmentary side elevation illustrating the manner in which a slave cylinder forming a part of the control system of the invention is connected to a valve hand lever in the arrangement shown in FIG. 3.

For the manually controlled hydraulic system, the control system of the invention provides a pair of slave hydraulic cylinders 104,106 that are respectively connected to valve hand levers 101,103 to operate them in the same manner as the hand of an operator. FIG. 4 shows how the piston rod 108 of slave cylinder 104 is connected by a clevis and pin connection 110 to hand lever 101, there being the same kind of connection between slave cylinder 106 and hand lever 103.

For operation of the slave cylinders 104,106, the control system of the invention includes an independent, auxiliary hydraulic power unit comprising a low pressure, low volume pump 112 having a built-in tank or reservoir 114 and return line filter 116. The pump 112 is connected by a conduit 118 to a pair of solenoid operated two-way valves 120 and 122, the valves being connected by a return line 124 to the tank 114. Valve 120 is connected by conduits 126,128 to the U and D ports of slave cylinder 104 and valve 122 is connected by conduits 130,132 to the U and D ports of slave cylinder 106.

From the above description, it will be apparent that the valves 120 and 122 control the direction of the fluid from the auxiliary hydraulic power unit through the conduits 126,128 and 130,132 and therefore control the direction of the fluid in the existing hydraulic system through the conduits 19,21 and 23,25. The valves 120 and 122 for the manually controlled hydraulic system therefore serve exactly the same function as valves 26 and 32, FIGS. 1 and 2, in the control system for the semi-automatic hydraulic system. This being the case, the same electronic circuitry can be used for controlling valves 120 and 122 as is used for controlling valves 26 and 32. This circuitry is shown schematically within a dash line enclosure 134 in FIGS. 2 and 3 and is represented by the electronic controls within the dash line enclosure 136 in FIG. 1. The same feed-back devices, e.g. the limit switches 52,54 and pressure switches 66–69, that coact with the electronic controls in the control system of FIGS. 1 and 2 occupy the same locations and coact in the same manner with the electronic controls in the control system of FIG. 3.

With the arrangement just described, placing the MAN-AUTO switch 40 in the automatic position and closing the RAISE switch 42, FIG. 1, will cause the control system of FIG. 3 to operate the vehicle press just as described for the control system of FIGS. 1 and 2, with automatic repetition of the crushing cycles being achieved if desired by placing the auto-recycle switch 46 in ON position. It should be noted in this connection that, like the spring loaded spools of the solenoid valves 26,32 and 120,122, the hand lever operated valves 100 and 102 in FIG. 3 are of the spring return to neutral type and must be held in position to operate.

From the foregoing description, it will be apparent that the invention provides a novel and very advantageous automatic control system for use with a commercially available type of vehicle crushing press. As will be understood by those familiar with the art, the invention may be embodied in other specific forms without departing from the spirit or essential characteristics thereof.

We claim:

1. A control system for a vehicle crushing press, said press including an elongated base, an elongated pressure head that can be moved vertically toward the base to crush a vehicle positioned thereon and a power unit at each end of the pressure head for moving the latter toward and away from the base; the improvement comprising a lower control and a raise control normally operable to simultaneously actuate the pressure head power units to respectively move the head toward or away from the base, a skew control forming a part of the lower control and operable when actuated to cause alternate actuation of the pressure head power units, means responsive to a build-up of a first predetermined pressure in either power unit to actuate the skew control, means responsive to the build-up of a second and higher predetermined pressure in both power units to render the lower control inoperable and the raise control operable, and means forming a part of the raise control to render the latter inoperable when the pressure head reaches its uppermost position.

2. A control system as defined in claim 1 wherein the pressure head power units are cylinders with fluid actuated pistons.

3. A control system as defined in claim 1 wherein the skew control includes time delay circuits for controlling the length of time that each power unit is actuated.

4. A control system as defined in claim 1 wherein the means responsive to the pressure build-ups in the power units are pressure switches.

5.. A control system as defined in claim 1 including an automatic recycle control, said last-named means including a time delay circuit and means operable when the pressure head reaches its uppermost position to render the lower control operable after a delay controlled by the time delay circuit.

* * * * *